US008608506B2

(12) United States Patent
Zhao

(10) Patent No.: US 8,608,506 B2
(45) Date of Patent: Dec. 17, 2013

(54) POWER TERMINAL CONNECTOR AND SYSTEM

(75) Inventor: Weiping Zhao, Superior Township, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 53 days.

(21) Appl. No.: 13/267,543

(22) Filed: Oct. 6, 2011

(65) Prior Publication Data

US 2013/0090000 A1 Apr. 11, 2013

(51) Int. Cl.
*H01R 13/52* (2006.01)

(52) U.S. Cl.
USPC ..... 439/522; 439/754

(58) Field of Classification Search
USPC ..... 439/388, 522, 754–759, 766, 801, 883, 439/884
See application file for complete search history.

(56) References Cited

U.S. PATENT DOCUMENTS

| | | | | |
|---|---|---|---|---|
| 3,064,231 | A * | 11/1962 | Satrum | 439/759 |
| 3,790,920 | A * | 2/1974 | Wening | 439/522 |
| 3,980,387 | A * | 9/1976 | Neidecker | 439/750 |
| 4,042,759 | A | 8/1977 | Cella | |
| 4,521,067 | A * | 6/1985 | Dufresne | 439/522 |
| 4,795,380 | A * | 1/1989 | Frantz | 439/860 |
| 4,830,624 | A * | 5/1989 | Rose et al. | 439/388 |
| 5,398,664 | A | 3/1995 | Betz | |
| 6,398,595 | B2 * | 6/2002 | Wakata et al. | 439/755 |
| 6,409,553 | B1 | 6/2002 | Krause et al. | |
| 6,817,893 | B2 * | 11/2004 | Schmid et al. | 439/522 |
| 6,830,490 | B2 * | 12/2004 | Murakami et al. | 439/755 |
| 7,294,020 | B2 | 11/2007 | Zhao et al. | |
| 7,549,889 | B2 | 6/2009 | Sikora | |

FOREIGN PATENT DOCUMENTS

| | | |
|---|---|---|
| EP | 1 439 610 A2 | 7/2004 |
| EP | 2 290 752 A1 | 3/2011 |
| FR | 2 696 505 A1 | 4/1994 |

OTHER PUBLICATIONS

Kostal; Automobile connectors for high voltage (HV) applications; 5 pg.s.
International Search Report, International Application No. PCT/US2012/058598, International Filing Date, Apr. 10, 2012.

* cited by examiner

*Primary Examiner* — Thanh Tam Le

(57) ABSTRACT

A power terminal connector having a terminal body that has a socket configured to receive, and be electrically connected to, a pin of a power terminal. A spring clip is coupled to the terminal body. The spring clip is movable between a locking position and a clearance position. The spring clip is configured to engage the pin of the power terminal in the locking position to secure the power terminal connector to the power terminal. The spring clip is configured to be disengaged from the pin of the power terminal in the clearance position. A cap is coupled to the terminal body. The cap is coupled to the spring clip to move the spring clip between the locking position and the clearance position as the cap is actuated.

21 Claims, 7 Drawing Sheets

POWER TERMINAL CONNECTOR AND SYSTEM

BACKGROUND OF THE INVENTION

The subject matter herein relates generally to connector systems having power terminal connectors.

Power terminal connectors are used in different types of connector systems. One application is an automotive application, such as for connection to a battery of a vehicle. In some applications, spacing around the battery, such as above the battery, in front of the battery, to one side or the other of the battery, may be limited. There may not be room for a power terminal connector to extend into such space, or there may not be room around the battery to get a tool for connecting and un-connecting the power terminal connector to the power terminal of the battery. Additionally, connecting and un-connecting the power terminal connector to the power terminal of the battery may be time consuming or require special, expensive tools.

A need remains for a power terminal connector that may be connected to a power terminal in an efficient manner. A need remains for a power terminal connector that may be connected to a power terminal with minimal impact on the environment surrounding the power terminal.

BRIEF DESCRIPTION OF THE INVENTION

In one embodiment, a power terminal connector is provided having a terminal body that has a socket configured to receive, and be electrically connected to, a pin of a power terminal. A spring clip is coupled to the terminal body and is movable between a locking position and a clearance position. The spring clip is configured to engage the pin of the power terminal in the locking position to secure the power terminal connector to the power terminal. The spring clip is configured to be disengaged from the pin of the power terminal in the clearance position. A cap is coupled to the terminal body. The cap is coupled to the spring clip to move the spring clip between the locking position and the clearance position as the cap is actuated.

In another embodiment, a connector system is provided having a header that has a power terminal. The power terminal has a pin. A power terminal connector is coupled to the power terminal of the header. The power terminal connector has a terminal body having a socket receiving, and being electrically connected to, the pin of the power terminal. A spring clip is coupled to the terminal body and is movable between a locking position and a clearance position. The spring clip engages the pin of the power terminal in the locking position to secure the power terminal connector to the power terminal. The spring clip is disengaged from the pin of the power terminal in the clearance position. A cap is coupled to the terminal body. The cap is coupled to the spring clip to move the spring clip between the locking position and the clearance position as the cap is actuated.

In a further embodiment, a connector system is provided having a battery that has a buss bar at a mounting pad. A header is coupled to the battery at the mounting pad. The header has a power terminal coupled to the buss bar. The power terminal has a pin. A power terminal connector is coupled to the power terminal of the header. The power terminal connector has a terminal body that has a socket receiving, and being electrically connected to, the pin of the power terminal. A spring clip is coupled to the terminal body and is movable between a locking position and a clearance position. The spring clip engages the pin of the power terminal in the locking position to secure the power terminal connector to the power terminal. The spring clip is disengaged from the pin of the power terminal in the clearance position. A cap is coupled to the terminal body. The cap is coupled to the spring clip to move the spring clip between the locking position and the clearance position as the cap is actuated.

DETAILED DESCRIPTION OF THE INVENTION

Figure 1:
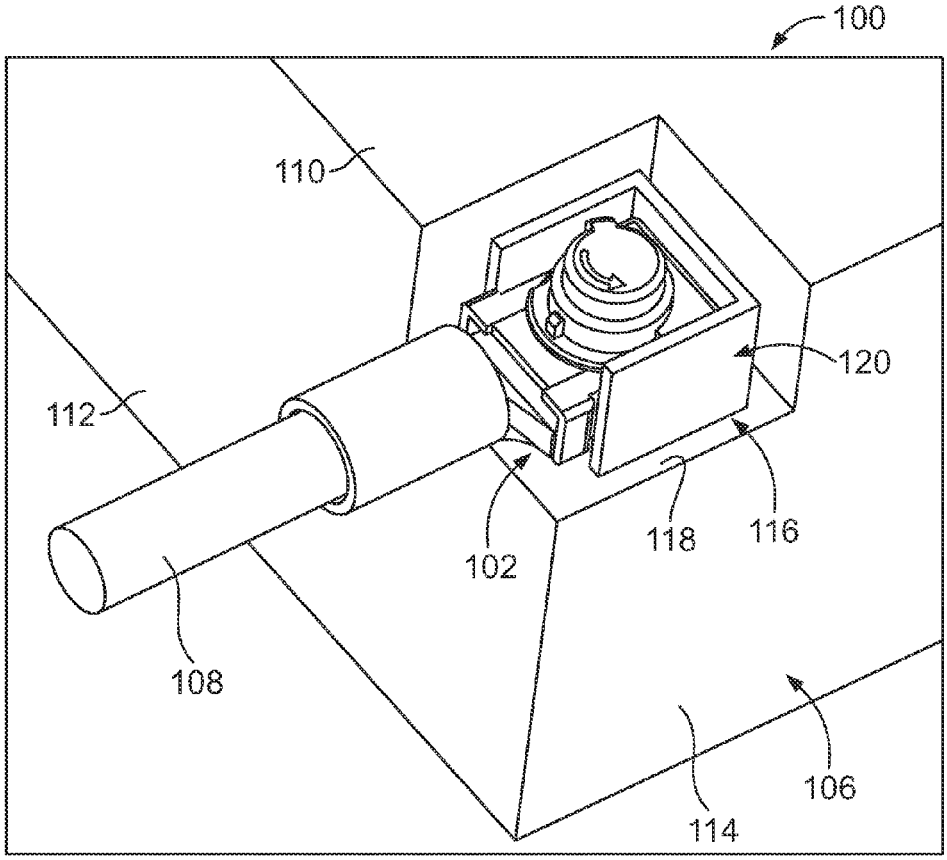
FIG. 1 illustrates a connector system formed in accordance with an exemplary embodiment.

FIG. 1 illustrates a connector system 100 formed in accordance with an exemplary embodiment. The connector system 100 includes a power terminal connector 102 that is terminated to a power terminal 104 (shown in FIG. 2) of a component, such as a battery 106. The power terminal connector 102 is terminated to an end of a cable 108. The battery 106 may be any voltage battery used in a vehicle. Optionally, the vehicle may be an electrical or hybrid electric vehicle and the battery 106 may be used as part of the power system for the electric vehicle or hybrid electrical vehicle.

The power terminal connector 102 is a quick connect/quick disconnect type of connector that may be easily and quickly terminated to the power terminal 104. The power terminal connector 102 has a very low profile so as to conserve space around the battery 106.

The battery 106 includes a top 110, a front 112 perpendicular to the top 110, and a side 114 perpendicular to the top 110 and the front 112. The top 110, front 112 and side 114 generally meet at a corner of the battery 106. In an exemplary embodiment, the battery 106 includes a notched-out area 116 at the corner. The notched-out area 116 is recessed below the top 110, behind the front 112, and inward from the side 114. The notched-out area 116 defines a window or envelope defined by planes extending along the top 110, front 112 and side 114.

The power terminal 104 and power terminal connector 102 are positioned within the notched-out area 116. The battery 106 includes a mounting pad 118 at the bottom of the notched-out area 116. The power terminal 104 extends from the mounting pad 118. A header 120 is coupled to the mounting pad 118. The power terminal connector 102 is coupled to the header 120. In an exemplary embodiment, the header 120 is received in the notched-out area 116 such that the header 120 does not extend beyond the top 110, the front 112 or the side 114. The power terminal connector 102 is coupled to the power terminal 104 and the header 120 such that the power terminal connector 102 does not extend beyond (e.g., above) the top 110. The power terminal connector 102 is coupled to the power terminal 104 and the header 120 such that the power terminal connector 102 does not extend beyond (e.g., outward from) the side 114. A portion of the power terminal connector 102 and/or the cable 108 extends from the front 112. As such, other components, such as another battery may be positioned immediately adjacent the side 114 without interference from the header 120 or the power terminal connector 102. Another component, such as a cover or lid may extend along the top 110 without interference from the header 120 or the power terminal connector 102.

In an alternative embodiment, rather than having the cable 108 and the power terminal connector 102 extending from the front 112, the cable 108 and the power terminal connector 102 may extend from the side 114. In such embodiment, the power terminal connector 102 may not extend beyond the (e.g., forward of) the front 112. In other alternative embodiments, the power terminal connector 102 may be coupled to a battery or other component that is not recessed or that does not include a header.

Figure 2:
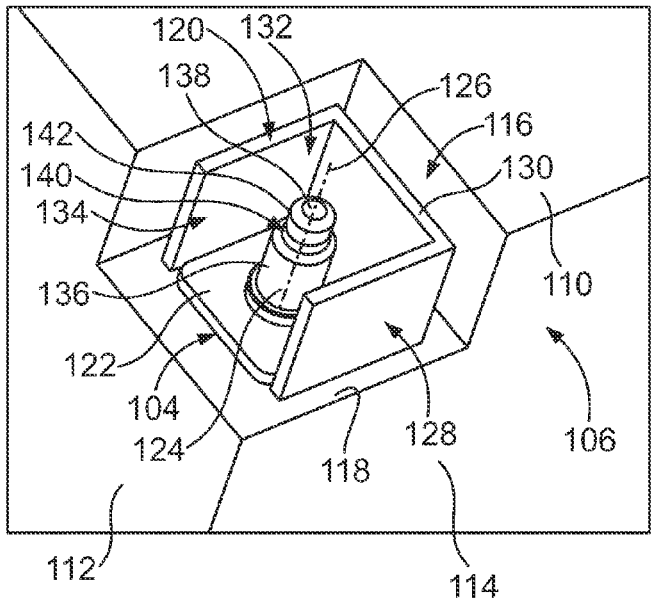
FIG. 2 illustrates a portion of a battery and header for use with the connector system shown in FIG. 1.

FIG. 2 illustrates a portion of the battery 106 showing the notched-out area 116 with the header 120 coupled to the battery 106 at the notched area 116. In an exemplary embodiment, the header 120 is a fixed connector of the battery 106 providing an interface for the power terminal connector 102 (shown in FIG. 1). The header 120 includes the power terminal 104.

The power terminal 104 includes a buss bar 122 and a pin 124 extending from, and electrically coupled to, the buss bar 122. The pin 124 extends along a pin axis 126 that is generally parallel to the front 112 and the side 114. In the illustrated embodiment, the buss bar 122 is generally planar and extends parallel to the top 110. The buss bar 122 is provided at the mounting pad 118.

The header 120 includes a header shroud 128 that partially surrounds the power terminal 104. The header shroud 128 includes a plurality of shroud walls 130. In an exemplary embodiment, the shroud walls 130 may be box-shaped. The header shroud 128 has an open top 132 and an open front side 134. The shroud walls 130 surround the other sides of the power terminal 104, such as the back side, the inner side and the outer side of the power terminal 104. In an exemplary embodiment, the shroud walls 130 are non-conductive and protect against inadvertent touching of the power terminal 104.

The pin 124 includes an outer contact surface 136. The pin 124 extends to a distal end 138. In an exemplary embodiment, a groove 140 is defined proximate to the distal end 138. A pin head 142 is defined above the groove 140 such that the pin 124 has a larger diameter portion above the groove 140. The groove 140 is a smaller diameter portion of the pin 124. Optionally, the pin head 142 may be plastic to make the pin 124 touch safe.

During assembly, the power terminal connector 102 is loaded into the header shroud 128 through the open top 132. When the power terminal connector 102 is connected to the power terminal 104, the terminal power connector 102 extends from the header shroud 128 through the open front side 134. When the power terminal connector 102 is coupled to the power terminal 104, a portion of the power terminal connector 102 is received in the groove 140 to secure the power terminal connector 102 to the pin 124. In an exemplary embodiment, the power terminal connector 102 cannot be inadvertently released from the power terminal 104. Rather, a deliberate action is taken to release the power terminal connector 102 from the groove 140, after which the power terminal connector 102 may be lifted off the pin 124 in a direction parallel to the pin axis 126.

Figure 3:
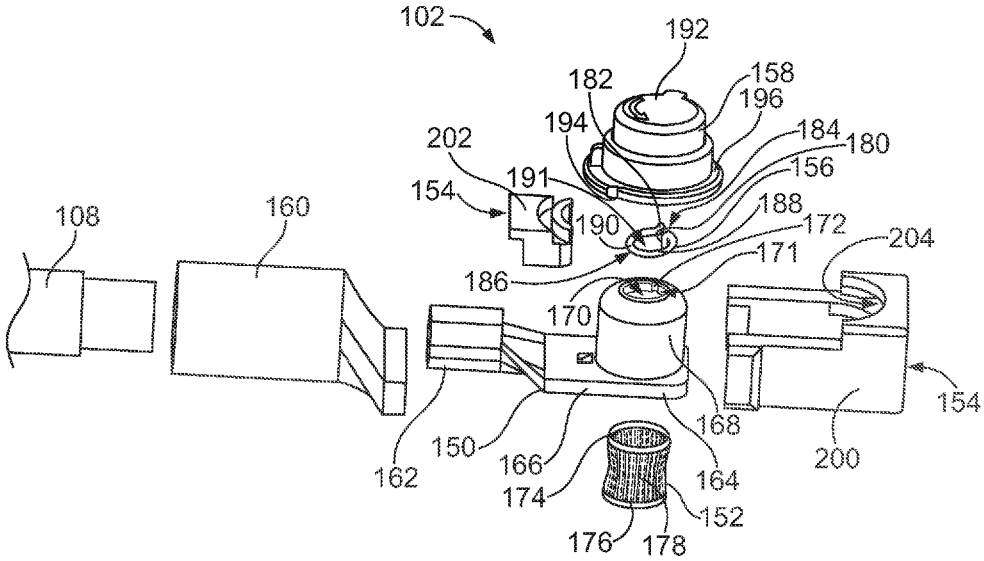
FIG. 3 is an exploded view of a power terminal connector of the connector system shown in FIG. 1.

FIG. 3 is an exploded view of the power terminal connector 102. The power terminal connector 102 includes a terminal body 150 that is configured to be electrically connected to the power terminal 104 (shown in FIG. 2). The terminal body 150 is configured to be terminated to the end of the cable 108. The power terminal connector 102 includes a contact spring 152 that is received in the terminal body 150. The contact spring 152 is used to electrically connect the terminal body 150 to the pin 124 (shown in FIG. 2). The power terminal connector 102 includes a housing 154 that at least partially surrounds the terminal body 150. The housing 154 protects the terminal body 150 from inadvertent touching by a person or a tool, which could cause electrical shock that could injure the person or the power terminal connector 102. The power terminal connector 102 includes a spring clip 156 that is used to secure the power terminal connector 102 to the pin 124. The power terminal connector 102 includes a cap 158 that is configured to be rotatably coupled to the terminal body 150. The cap 158 is used to actuate the spring clip 156 to unlock the power terminal connector 102 from the pin 124, as described in further detail below. Optionally, the power terminal connector 102 may include a sleeve 160 that is coupled to the cable 108 and is configured to cover a portion of the terminal body 150. The sleeve 160 protects the terminal body 150 from inadvertent touching by a person or a tool, in a similar manner as the housing 154. Optionally, the sleeve 160 may be a heat shrink tube.

The terminal body 150 extends between a terminating end 162 and a mating end 164. The terminating end 162 is configured to be terminated to the cable 108. In an exemplary embodiment, the terminating end 162 includes a crimp ferrule that may be crimped to the cable 108. The terminating end 162 may be terminated to the cable 108 by other means in alternative embodiments, such as soldering to the end of the cable 108. The terminal body 150 includes a base 166 extending between the terminating end 162 and the mating end 164.

A socket 168 extends from the base 166 at the mating end 164. In an exemplary embodiment, the socket 168 includes a hollow chamber 170. Optionally, the chamber 170 may be open at both ends thereof for receiving the pin 124 through the bottom end of the socket 168. In an exemplary embodiment, the outer surface of the socket 168, as well as the inner surface defining the chamber 170, are generally cylindrical in shape. Other shapes are possible in alternative embodiments. In an exemplary embodiment, the chamber 170 is open at the base 166 for receiving the contact spring 152 and the pin 124 (shown in FIG. 2). The top of the socket 168 includes an opening 171 that is open to the chamber 170 such that the pin 124 may extend through the opening 171. The socket 168 includes a pocket 172 that receives a portion of the spring clip 156. In the illustrated embodiment, the pocket 172 is provided at the top of the socket 168 and extends generally parallel to a longitudinal axis of the socket 168.

The contact spring 152 extends between a first end 174 and a second end 176. The contact spring 152 has a circumferential band at the first end 174 and another circumferential band at the second end 176. A plurality of spring beams 178 extend between the circumferential bands at the first and second ends 174, 176. In the illustrated embodiment, the spring beams 178 are inwardly tapered towards the middle of the contact spring 152. The contact spring 152 is necked-down at the middle of the contact spring 152. The contact spring 152 has a smaller diameter at the middle of the contact spring 152 and larger diameters at the first and second ends 174, 176. The necked-down portion of the contact spring 152 is configured to engage the pin 124. The first and second ends 174, 176 are configured to engage the socket 168 when the contact spring 152 is loaded into the chamber 170. In an exemplary embodiment, the spring beams 178 are deflectable and may be deflected outward when the pin 124 is loaded into the contact spring 152. The contact spring 152 defines an electrical path between the pin 124 and the terminal body 150.

The spring clip 156 has a curved shape and extends between a first end 180 and a second end 182. The spring clip 156 has an open side 184 with the first and second ends 180, 182 opposing one another at the open side 184. The spring clip 156 has a closed side 186 opposite the open side 184. The spring clip 156 has a first arm 188 and a second arm 190 joined at the closed side 186. The first arm 188 extends to the first end 180. The second arm 190 extends to the second end 182. An opening 191 is created between the first and second arms 188, 190.

In an exemplary embodiment, the first and second end 180, 182 may be moved away from one another to spread the first and second arms 188, 190 apart from one another. When the first and second arms 188, 190 are spread apart from one another, the size of the opening 191 therebetween is enlarged.

The spring clip 156 is movable between a locking position and a clearance position. The spring clip 156 is configured to engage the pin 124 in the locking position to secure to the power terminal connector 102 to the power terminal 104. The spring clip 156 is configured to be disengaged from the pin 124 in the clearance position. Optionally, in the locking position, the first and second ends 180, 182 are relatively close to one another. The first and/or second end 180, 182 are moved away from one another to enlarge the size of the opening of the spring clip 156 as the spring clip 156 is moved to the clearance position. The spring clip 156 is elastically deformed as the spring clip 156 is moved from the locking position to the clearance position. When the first and second ends 180, 182 are no longer forced apart from one another, the spring clip 156 returns to the normal locking position.

In an exemplary embodiment, the first end 180 is configured to be securely coupled to the terminal body 150. In an exemplary embodiment, the first end 180 is configured to be received in the pocket 172. The first end 180 is fixed in position relative to the socket 168 when the first end 180 is received in the pocket 172. The second end 182 is configured to be coupled to the cap 158. As the cap 158 is rotated, the second end 182 is moved with respect to the first end 180 to move the spring clip 156 from the locking position to the clearance position.

In the illustrated embodiment, the second end 182 extends radially outward, while the first end 180 extends axially outward. The first end 180 is oriented generally perpendicular with respect to the second end 182. Other orientations of the first and second ends 180, 182 are possible in alternative embodiments. The first end 180 may be secured to the terminal body 150 by alternative means in alternative embodiments.

The cap 158 includes a top 192 and a bottom 194. The cap 158 is hollow and is configured to be placed over the socket 168. The cap 158 includes a rim 196 at the bottom 194. The cap 158 is configured to be rotatably coupled to the terminal body 150. In an exemplary embodiment, the housing 154 is used to secure the cap 158 in position with respect to the terminal body 150 and the spring clip 156. The cap 158 is rotatable with respect to the housing 154.

The housing 154 is coupled to the terminal body 150. The housing 154 is manufactured from a dielectric material, such as a plastic material. The housing 154 surrounds the terminal body 150 to prevent inadvertent touching of the terminal body 150 by a person or another component such as a tool, a wire and the like. In the illustrated embodiment, the housing 154 is a two part housing including a main housing 200 and a spacer 202 (shown in FIG. 4). The spacer 202 is placed over the terminal body 150 proximate to the terminating end 162. The spacer 202 is configured to be placed alongside the socket 168 on top of the base 166. The main housing 200 is coupled to the opposite side of the terminal body 150 and extends along the base 166 and the socket 168. The main housing 200 includes a pocket 204 that is configured to receive the rim 196 of the cap 158. The cap 158 is captured in the pocket 204 to secure the cap 158 to the terminal body 150. The cap 158 is rotatable within the pocket 204.

Figure 4:
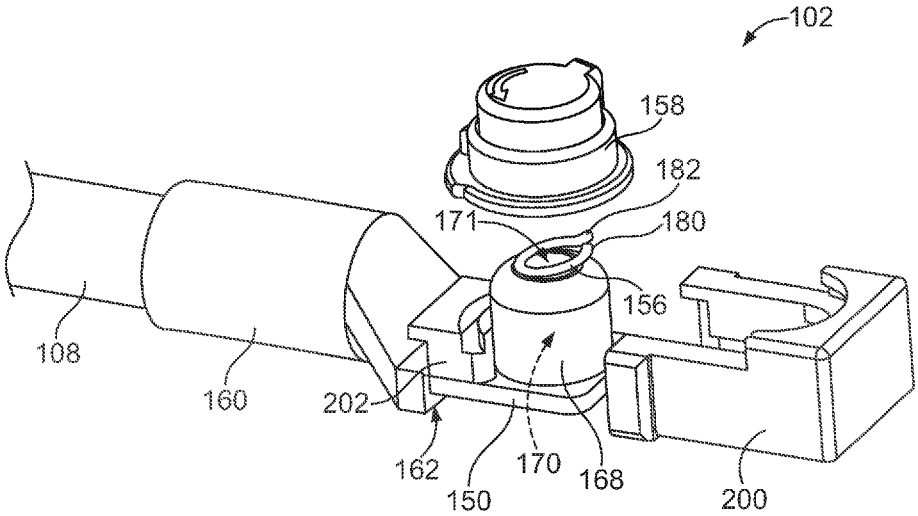
FIG. 4 is a partial assembled view of the power terminal connector shown in FIG. 3.

FIG. 4 is a partial assembled view of the power terminal connector 102. During assembly, the heat shrink tube 160 is fed over the end of the cable 108. The terminal body 150 is terminated to the end of the cable 108. For example, the terminating end 162 may be crimped to the end of the cable 108. The heat shrink tube 160 is then positioned over the cable 108 and the terminating end 162 of the terminal body 150. The heat shrink tube 160 covers the interface between the terminating end 162 and the cable 108.

During assembly, the spring clip 156 is coupled to the terminal body 150 at the socket 168. For example, the first end 180 of the spring clip 156 is loaded into the pocket 172 (shown in FIG. 3) at the top of the socket 168. Optionally, the spring clip 156 may be positioned immediately above the top of the socket 168. The opening of the spring clip 156 is aligned with the opening 171 in the top of the socket 168.

During assembly, the spacer 202 is positioned on the terminal body 150 between the heat shrink tube 160 and the socket 168. The cap 158 may then be mounted to the terminal body 150. The cap 158 is loaded onto the socket 168. The second end 182 of the spring clip 156 is coupled to the cap 158. For example, the second end 182 may be received in a slot or channel in the cap that retains the second end 182. The main housing 200 is coupled to the terminal body 150. The main housing 200 captures the spacer 202 and the cap 158 when coupled to the terminal body 150. The main housing 200 is secured to the terminal body 150, such as by an interference fit or by using a latching feature or other type of securing feature. For example, the terminal body 150 may include a locking lance or barb that engages the main housing 200 to secure the terminal body 150 in the main housing 200.

Figure 5:
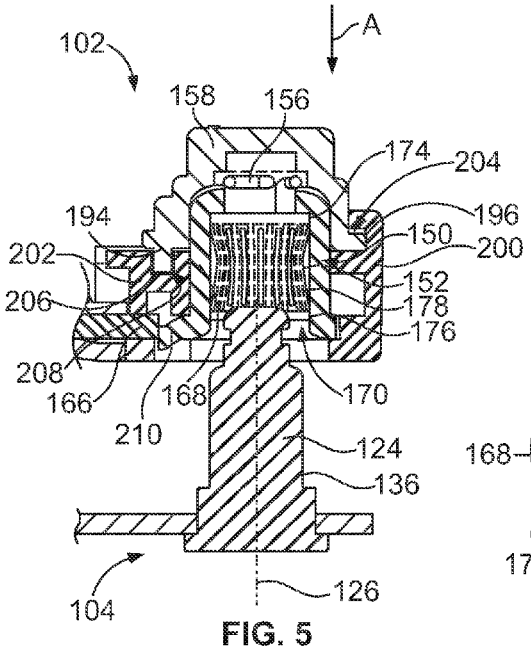
FIG. 5 is a cross-sectional view of the power terminal connector shown in FIG. 3 being coupled to a power terminal.

FIG. 5 is a cross-sectional view of the power terminal connector 102 being coupled to the power terminal 104. The power terminal connector 102 is loaded onto the pin 124 along the pin axis 126. The power terminal connector 102 is loaded in a loading direction, shown by arrow A.

When the power terminal connector 102 is assembled, the spring clip 156 is coupled to the terminal body 150 and to the cap 158. The contact spring 152 is loaded into the chamber 170 of the socket 168. In an exemplary embodiment, the contact spring 152 is held in the chamber 170 by an interference fit. For example, the first and second ends 174, 176 may be biased against the socket 168. The spring beams 178 extend inward into the chamber 170. The spring beams 178 are configured to engage the contact surface 136 of the pin 124.

The cap 158 extends over the top of the socket 168. The rim 196 of the cap 158 is captured in the pocket 204. In an exemplary embodiment, the cap 158 includes a tab 206 extending from the bottom 194. The tab 206 is received in a channel 208 formed in the spacer 202. The channel 208 guides the tab 206 as the cap 158 is rotated to actuate the spring clip 156.

In an exemplary embodiment, the terminal body 150 includes a locking lance 210 extending downward from the base 166. The locking lance 210 extends into a corresponding opening in the main housing 200 to secure the terminal body 150 in the main housing 200.

Figure 6:
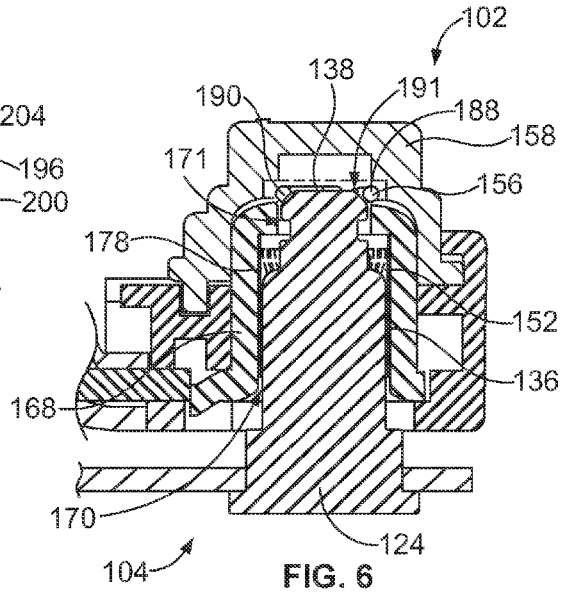
FIG. 6 is another cross-sectional view of the power terminal connector being coupled to the power terminal showing the power terminal connector during an intermediate stage of assembly.

FIG. 6 is a cross section view of the power terminal connector 102 being coupled to the power terminal 104. FIG. 6 shows an intermediate stage of assembly. The power terminal connector 102 is electrically connected to the power terminal 104, however the power terminal connector 102 is in an unseated position. The power terminal connector 102 should be fully seated and locked for proper use.

In the unseated position, the power terminal connector 102 is loaded onto the pin 124 such that the pin 124 is received in the chamber 170. The contact surface 136 engages the spring beams 178 of the contact spring 152. The pin 124 extends through the upper opening 171 of the socket 168, however, the distal end 138 of the pin 124 engages the spring clip 156. The spring clip 156 interferes with the distal end 138, stopping the pin 124 from being fully loaded into the power terminal connector 102. The width of the opening 191 between the first and second arms 188, 190 is narrower than the diameter of the distal end 138. In order for the pin 124 to pass through the spring clip 156, and thus allowing the power terminal connector 102 to move to the fully seated position, the spring clip 156 must be moved to the clearance position. The cap 158 is rotated to move the second end 182 (shown in FIG. 3) with respect to the first end 180 (shown in FIG. 3) to spread the second arm 190 apart from the first arm 188 to widen the opening 191, allowing the power terminal connector 102 to be fully seated on the power terminal 104. The cap 158 may be moved in other ways to seat the power terminal connector 102. For example, the cap 158 may be pressed downward to apply a vertical down force on the power terminal connector 102, which may force the spring clip 156 to slide along the large radius of the pin 124 until the spring clip 156 clears the distal end 138. The spring clip 156 may be spread apart to the clearance position by the interaction with the pin 124 when the power terminal connector 102 is pressed in a vertically downward direction on the pin 124.

Figure 7:
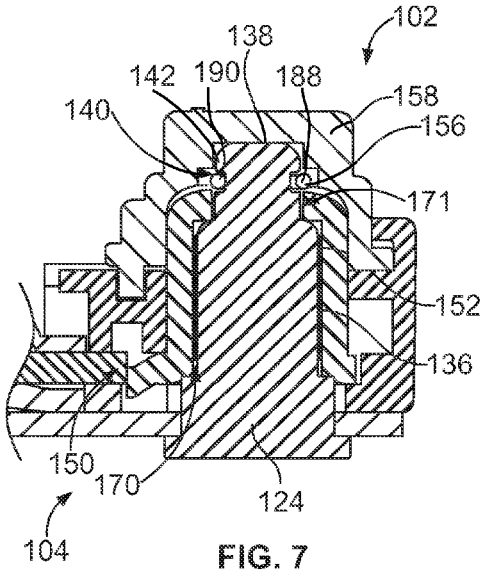
FIG. 7 is another cross-sectional view of the power terminal connector and the power terminal showing the power terminal connector in a seated and locked state.

FIG. 7 is a cross-sectional view of the power terminal connector 102 and power terminal 104 in a seated and locked state. In the fully seated state, the pin 124 is fully loaded into the chamber 170. The contact spring 152 engages the contact surface 136 of the pin 124. The contact spring 152 electrically interconnects the pin 124 and the terminal body 150. The distal end 138 of the pin 124 extends through the upper opening 171 and through the spring clip 156 into the cap 158. In the seated state, the spring clip 156 is captured in the groove 140.

The spring clip 156 is in the locking position, in which the first and second arms 188, 190 are positioned in the groove 140, which has a smaller radius than the pin head 142, below the pin head 142. The pin head 142 captures the spring clip 156 to lock the relative position of the power terminal connector 102 with respect to the power terminal 104.

Figure 8:
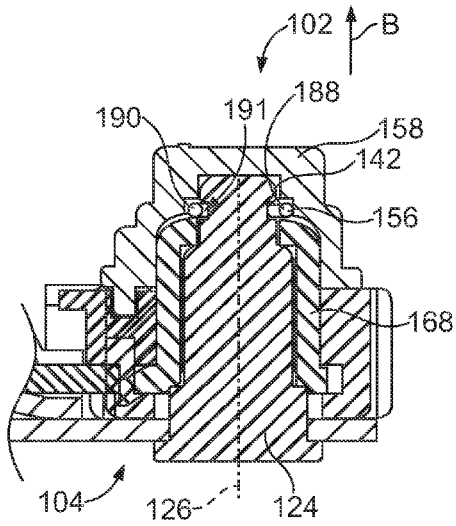
FIG. 8 is another cross-sectional view of the power terminal connector and the power terminal showing the power terminal connector unlocked from the power terminal.

FIG. 8 is a cross-sectional view of the power terminal connector 102 in an unlocked position with respect to the power terminal 104. In the unlocked position, the spring clip 156 is moved to the clearance position. For example, the cap 158 is rotated to rotate the second end 182 (shown in FIG. 3) with respect to the first end 180, which is fixed in position with respect to the socket 168. Rotation of the cap 158 spreads the second arm 190 apart from the first arm 188 and widens the opening 191 at least as wide as the pin head 142. The spring clip 156 is disengaged from the pin 124 in the clearance position. Once the power terminal connector 102 is in the unlocked position and the spring clip 156 is in the clearance position, the power terminal connector 102 may be unconnected from the power terminal 104 by lifting the power terminal connector 102 off of the pin 124 in a direction parallel to the pin axis 126, such as in the direction of arrow B.

Figure 9:
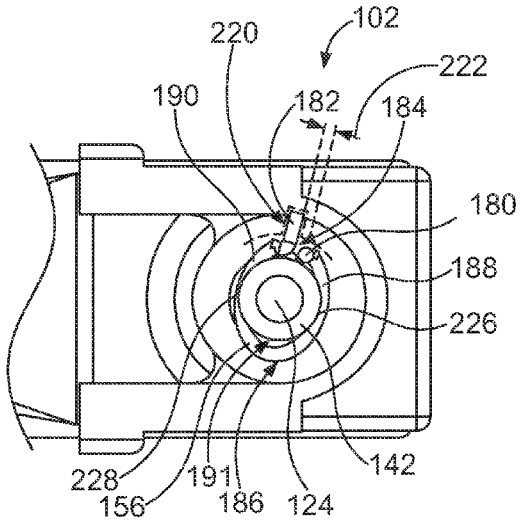
FIG. 9 is a top view of a portion of the power terminal connector in a locked state.
Figure 10:
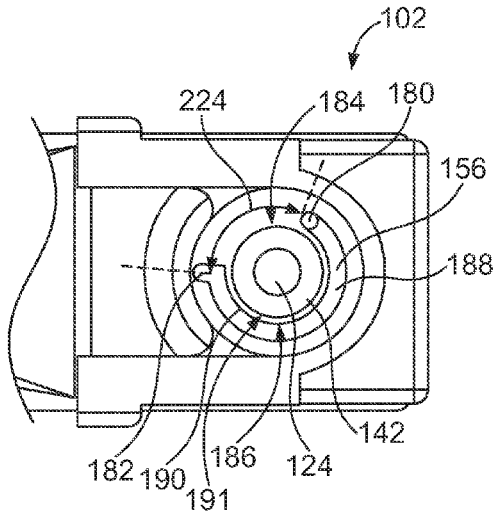
FIG. 10 is a top view of a portion of the power terminal connector in an unlocked state.

FIGS. 9 and 10 are top views of a portion of the power terminal connector 102 with the cap 158 (shown in FIG. 3) removed for clarity. FIG. 9 illustrates the power terminal connector 102 in a locked state. FIG. 10 illustrates the power terminal connector 102 in an unlocked state. FIG. 9 illustrates the spring clip 156 in a locking position. FIG. 10 illustrates the spring clip 156 in a clearance position.

The second end 182 of spring clip 156 extends radially outward and is configured to be captured in the cap 158. For example, the cap 158 may include a slot 220 (shown in phantom in FIG. 9) that receives the second end 182. The second end 182 is captured in the slot 220 such that, as the cap 158 is rotated, the second end 182 is rotated with the cap 158.

The spring clip 156 changes shape when the cap 158 is rotated. For example, in the illustrated embodiment, in the locking position, the spring clip 156 has a generally oval shape, and in the clearance position, the spring clip 156 has an open sided ring shape. The width of the opening 191 is increased as the spring clip 156 is moved from the locking position to the clearance position.

The spring clip 156 is oriented with the open side 184 opposite the closed side 186. The distance between the first and second arms 188, 190 is more narrow than the distance between the open side 184 and the closed side 186. In the illustrated embodiment, the distance between the open side 184 and the closed side 186 is wider than the diameter of the pin head 142, while the width between the first and second arms 188, 190 approximately midway between the open side 184 and the closed side 186 is narrower than the diameter of the pin head. As such, the first and second arms 188, 190 are captured in the groove 140 (shown in FIG. 2) by the pin head 142. In the locking position, the first arm 188 engages one side 226 of the pin 124 while the second arm 190 engages an opposite side 228 of the pin 124.

In the locking position, the first and second ends 180, 182 are positioned relatively close to one another and are separated by a distance 222. In the clearance position, the second end 182 is moved away from the first end 180 as the cap 158 is rotated. The second end 182 is positioned a distance 224 from the first end 180 that is greater than the distance 222. In other embodiments, the first and second arms 188, 190 may be forced to slide along the large radius of distal end 138, thereby spreading the first and second arms 188, 190 wider to clear the distal end 138.

Figure 11:
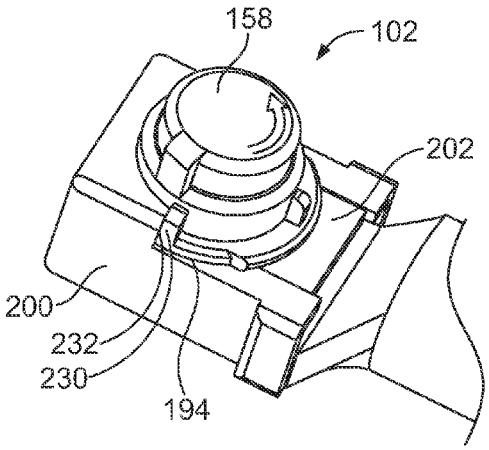
FIG. 11 is a top perspective view of the power terminal connector showing a cap in an unactuated position.
Figure 12:
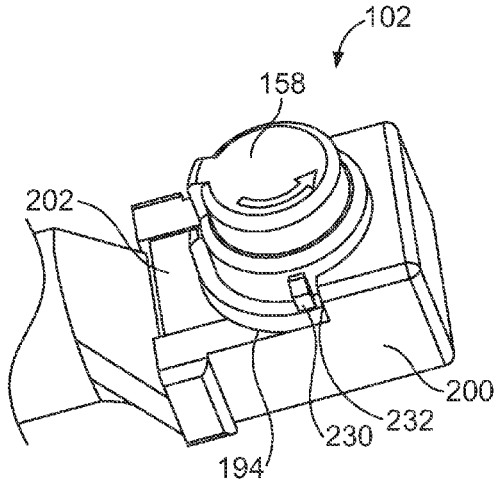
FIG. 12 is a top perspective view of the power terminal connector showing a cap in an actuated position.

FIGS. 11 and 12 are perspective views of the power terminal connector 102. FIG. 11 illustrates the cap 158 in an unactuated position. FIG. 12 illustrates the cap 158 in an actuated position. The cap 158 is rotated between the unactuated and the actuated positions. Rotation of the cap 158 causes the spring clip 156 to move from the locking position to the clearance position.

The cap 158 includes stops 230 extending radially outward therefrom. The stops 230 define rotation limits for the cap 158. The stops 230 engage shoulders 232 of the main housing 200 to stop rotation of the cap 158. In the illustrated embodiment, the stops 230 are positioned approximately 90° with respect to one another. The stops 230 allow approximately 90° of rotation for the cap 158. The stops 230 may be positioned at any angular position with respect to one another. While the stops 230 are illustrated as being external of the cap 158, the stops 230 may be positioned elsewhere in alternative embodiments. For example, the stops 230 may extend downward from the bottom 194 to engage the spacer 202 and/or the main housing 200 to limit rotation of the cap 158.

The power terminal connector 102 is configured for quick connection and disconnection from the power terminal 104 (shown in FIG. 2). During connection, the spring clip 156 can be forced to slide along the larger radius of the pin head 142, to be spread apart, and then further moved downward along the pin 124 to the groove 140, where the spring clip 156 snaps back to the locking position. Rotation of the cap 158 easily transfers the spring clip 156 between the locking position and the clearance position, allowing the power terminal connector to be removed from the power terminal 104.

Figure 13:
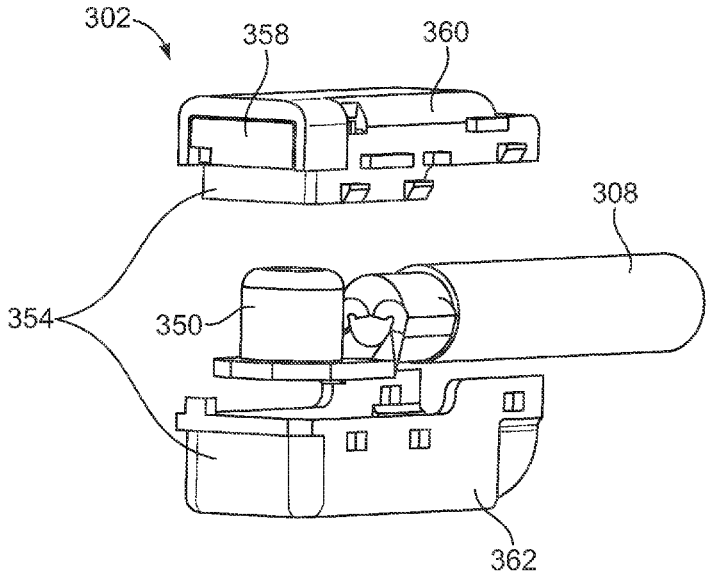
FIG. 13 is an exploded view of a power terminal connector formed in accordance with an exemplary embodiment.

FIG. 13 is an exploded view of a power terminal connector 302 formed in accordance with an exemplary embodiment. The power terminal connector 302 may be coupled to the power terminal 104 (shown in FIG. 2). The power terminal connector 302 includes a different means for actuating a spring clip for securing the power terminal connector 302 to the power terminal 104.

The power terminal connector 302 includes a terminal body 350 that is configured to be electrically connected to the power terminal 104. The terminal body 350 is configured to be terminated to the end of the cable 308. The power terminal connector 302 includes a contact spring therein, which may be similar to the contact spring 152 (shown in FIG. 3). The power terminal connector 302 includes a housing 354 that at least partially surrounds the terminal body 350. The housing 354 protects the terminal body 350 from inadvertent touching by a person or a tool, which could cause electrical shock that could injure the person or the power terminal connector 302. The power terminal connector 302 includes a spring clip 356 (shown in FIG. 14) that is used to secure the power terminal connector 302 to the pin 124 (shown in FIG. 2) of the power terminal 104. The power terminal connector 302 includes a cap 358 that is configured to be coupled to the terminal body 350. Optionally, the cap 358 may be coupled to the terminal body 350 using the housing 354. The cap 358 is used to actuate the spring clip 356 to unlock the power terminal connector 302 from the pin 124, as described in further detail below.

The housing 354 is coupled to the terminal body 350. The housing 354 is manufactured from a dielectric material, such as a plastic material. The housing 354 covers the terminal body 350 to prevent inadvertent touching of the terminal body 350 by a person or another component such as a tool, a wire and the like. In the illustrated embodiment, the housing 354 is a two part housing including an upper housing 360 and a lower housing 362. The upper housing holds and supports the spring clip 356 and the cap 358.

Figure 14:
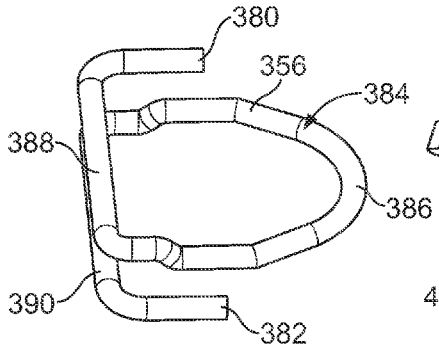
FIG. 14 illustrates a spring clip for the power terminal connector shown in FIG. 13.

FIG. 14 illustrates the spring clip 356. The spring clip 356 has a curved shape and extends between a first end 380 and a second end 382. The spring clip has a ring 384 that is configured to receive the pin 124. Optionally, the ring 384 may be elongated. The ring 384 may be oval shaped. The spring clip 356 has a closed side 386 at one side of the ring 384 that defines a pocket that receives the pin 124. The spring clip 356 has a first arm 388 and a second arm 390, both generally opposite the closed side 386 and both extending generally parallel to one another and vertically spaced apart from one another. The first and second arms 388, 390 may be movable with respect to one another. The first and second arms 388, 390 may be generally equidistant from the closed side 386. The first arm 388 extends to the first end 380. The second arm 390 extends to the second end 382. In the illustrated embodiment, the first and second arms 388, 390 are L-shaped with the first and second ends 380, 382 extending generally perpendicular to the other portions of the first and second arms 388, 390.

The spring clip 356 is movable between a locking position and a clearance position. The spring clip 356 is configured to engage the pin 124 in the locking position to secure to the power terminal connector 302 to the power terminal 104. The spring clip 356 is configured to be disengaged from the pin 124 in the clearance position. The spring clip 356 is movable from the locking position to the clearance position by pushing the first and second arms 388, 390 using the cap 358 (shown in FIG. 15), which changes the position of the ring 384 with respect to the pin 124, such that a wider portion of the ring 384 may be aligned with the pin 124 and the spring clip 356 may be lifted off of the pin 124. The spring clip 356 may be at least partially elastically deformed as the spring clip 356 is moved from the locking position to the clearance position.

Figure 15:
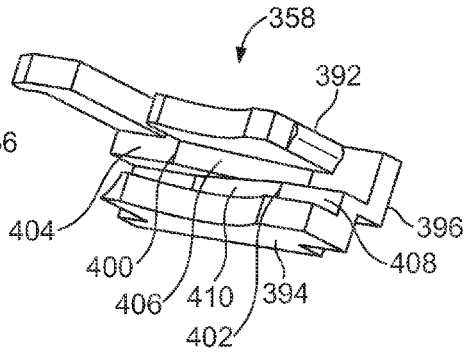
FIG. 15 illustrates a cap for the power terminal connector shown in FIG. 13.

FIG. 15 illustrates the cap 358. The cap 358 includes a top 392 and a bottom 394. The cap includes an actuation end 396 between the top 392 and the bottom 394. The cap 358 includes an upper pushing surface 400 and a lower pushing surface 402. The upper pushing surface 400 includes a forward wall 404 and an angled wall 406 angled rearward from the forward wall 404. The lower pushing surface 402 includes a forward wall 408 and an angled wall 410 angled rearward from the forward wall 408. The upper and lower pushing surfaces 400, 402 engaging the first and second arms 388, 390 (shown in FIG. 14), respectively.

Figure 16:
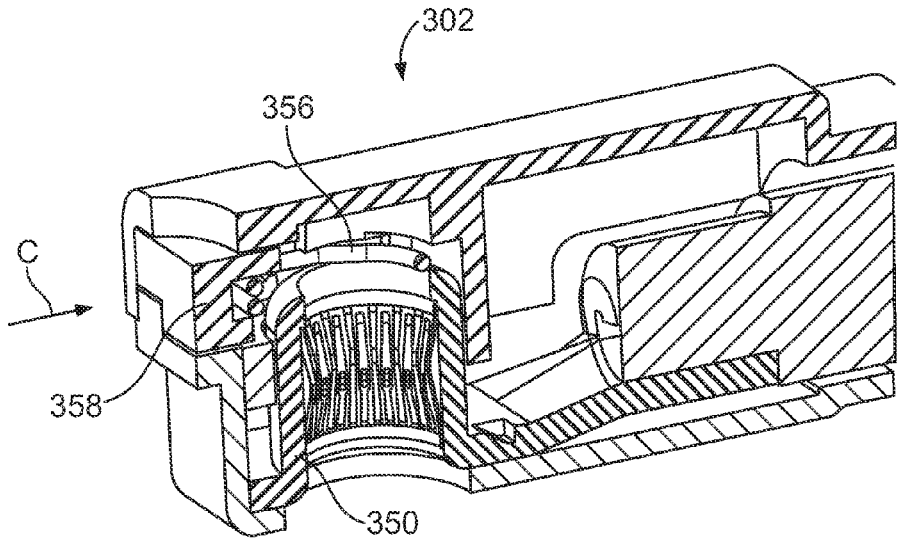
FIG. 16 is a cross-sectional view of the power terminal connector showing the cap and spring clip in an unactuated position.
Figure 17:
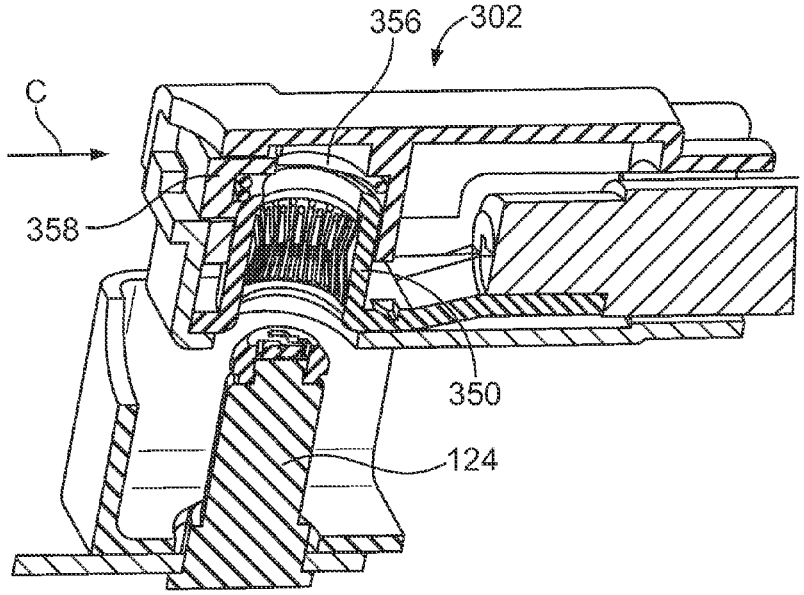
FIG. 17 is a cross-sectional view of the power terminal connector showing the cap and spring clip in an actuated position.

FIGS. 16 and 17 are cross-sectional views of the power terminal connector 302 showing the cap 358 and spring clip 356 in unactuated and actuated positions, respectively. When the cap 358 is unactuated, the spring clip 356 is in the locking position. When the cap 358 is actuated, the spring clip 356 is in the clearance position. In an exemplary embodiment, the cap 358 is actuated by pressing the cap 358 in a direction toward the terminal body 350, such as in the direction of arrow C. The spring clip 356 is shifted with the cap 358 to move the spring clip 356 relative to the pin 124.

Figure 18:
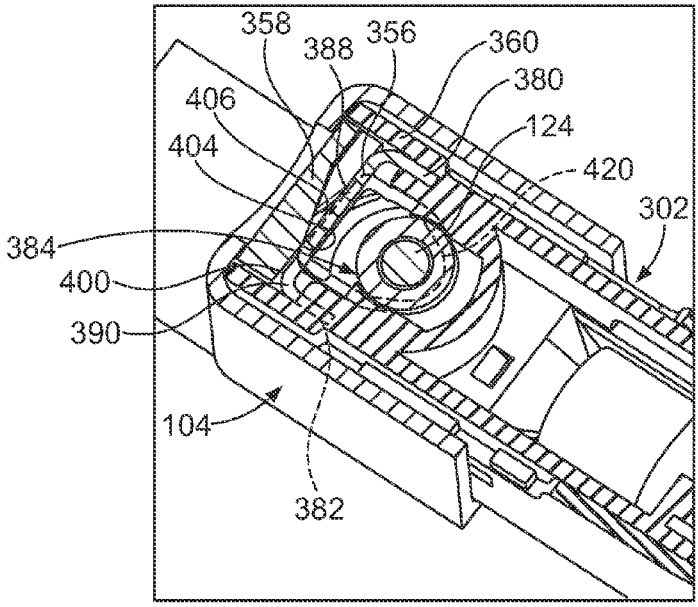
FIG. 18 is a cross-sectional view of the power terminal connector showing the cap and spring clip in an unactuated position.
Figure 19:
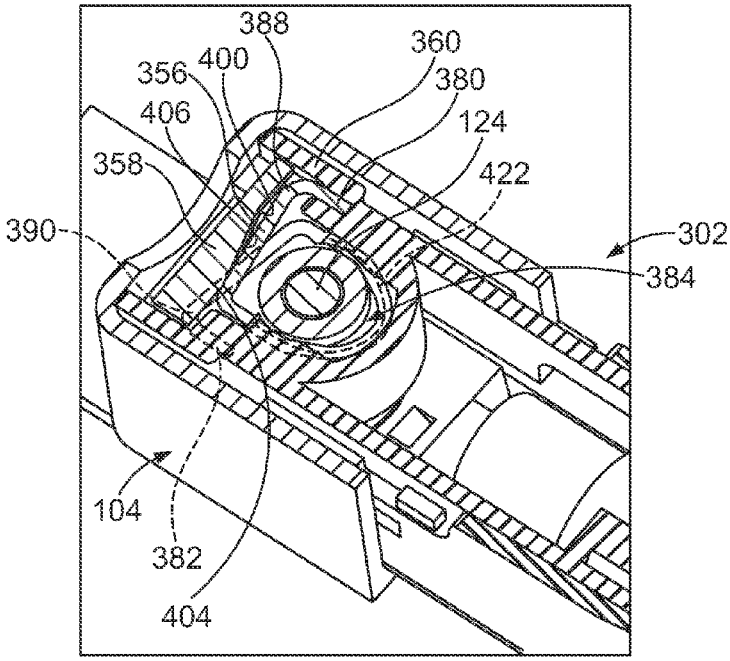
FIG. 19 is a cross-sectional view of the power terminal connector showing the cap and spring clip in an actuated position.

FIGS. 18 and 19 are cross-sectional views of the power terminal connector 302 coupled to the pin 124 of the power terminal 104, showing the cap 358 and spring clip 356 in unactuated and actuated positions, respectively. The path of the spring clip 356 with respect to the pin 124 is illustrated by the dashed lines 420, 422 in FIGS. 18 and 19, respectively.

When the cap 358 is unactuated, the spring clip 356 is in the locking position. As can be seen from the path 420 of the spring clip 356, the spring clip 356 is located in the groove 140 under the pin head 142 (both shown in FIG. 2). When the cap 358 is actuated, the spring clip 356 is in the clearance position. As can be seen from the path 422 of the spring clip 356, wider portion of the ring 384 of the spring clip 356 is aligned with the pin 124 such that the spring clip 356 may be lifted off of the pin 124.

When the cap 358 is actuated, the upper pushing surface 400 presses against the first arm 388. Part of the first arm 388 extends along and is pushed by the forward wall 404 and part of the first arm extends along and is pushed by the angled wall 406. The first arm 388 is deflected as the spring clip 356 is pushed forward. For example, because the first end 380 is fixed in the upper housing 360, the first arm 388 is bent as the spring clip 356 is pushed forward. The shape of the spring clip 356 changes as the cap 358 and spring clip 356 are actuated. The second arm 390 (shown in FIG. 14), is angled and deflected in a similar manner, however is angled in the opposite direction as the second end 382 is fixed at the opposite side of the housing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power terminal connector comprising:

a terminal body having a socket configured to receive, and be electrically connected to, a pin of a power terminal;

a spring clip coupled to the terminal body, the spring clip being movable between a locking position and a clearance position, the spring clip being configured to engage the pin of the power terminal in the locking position to secure and lock the power terminal connector to the power terminal, the spring clip being configured to be disengaged from the pin of the power terminal in the clearance position; and a cap coupled to the terminal body, the cap being coupled to the spring clip to move the spring clip between the locking position and the clearance position as the cap is actuated;

wherein the spring clip is a metal spring clip that changes shape when the cap is actuated.

2. The power terminal connector of claim 1, wherein the spring clip includes a first arm and a second arm, the first arm being spread apart from the second arm when the cap is pressed onto the pin.

3. The power terminal connector of claim 1, wherein the spring clip includes a first end and a second end, the first end being securely coupled to the terminal body, the second end being securely coupled to the cap, the first end remaining fixed in position when the cap is actuated, the second end being moved with the cap when the cap is actuated.

4. The power terminal connector of claim 1, further comprising a housing surrounding the terminal body, the cap being movable with respect to the housing, the spring clip having a first end and a second end and a ring between the first and second ends, the ring being configured to wrap at least partially around the pin in the locking position, the first and second ends being coupled to, and fixed in position with respect to, the housing, the ring moving laterally with the cap when the cap is actuated.

5. The power terminal connector of claim 1, wherein the spring clip includes a first end and a second end, the first end being securely coupled to the terminal body, the second end being securely coupled to the cap, the spring clip having a curved shaped with an open side, the first and second ends opposing one another at the open side of the spring clip, the second end being moved away from the first end as the cap is actuated to move the spring clip to the clearance position.

6. The power terminal connector of claim 1, wherein the spring clip has a first arm and a second arm joined at a closed side of the spring clip, the first arm extends to a first end, the second arm extends to a second end, the first end being securely coupled to the terminal body, the second end being securely coupled to the cap.

7. The power terminal connector of claim 1, wherein the spring clip has a first arm and a second arm joined at a closed side of the spring clip, the first arm extends to a first end, the second arm extends to a second end, the first arm engaging one side of the pin in the locking position, the second arm engaging an opposite side of the pin in the locking position.

8. The power terminal connector of claim 1, wherein the spring clip has a first arm and a second arm joined at a closed side of the spring clip, the first arm extends to a first end, the second arm extends to a second end, as vertical down force is applied to the terminal body, the spring clip is forced to slide along the pin, thereby spreading the first arm apart from the second arm to move the spring clip to the clearance position.

9. The power terminal connector of claim 1, wherein the spring clip has a first arm and a second arm joined at a closed side of the spring clip, the first arm extends to a first end, the second arm extends to a second end, the first arm being spread apart from the second arm as the cap is actuated and the spring clip is moved from the locking position to the clearance position.

10. The power terminal connector of claim 1, wherein the spring clip has a first arm and a second arm joined at a closed side of the spring clip, the first arm extends to a first end, the second arm extends to a second end, wherein in the locking position, the first and second arms are received in a groove of the pin, and in the clearance position, the first and second arms clear the pin such that the spring clip is free to move along the pin.

11. The power terminal connector of claim 1, further comprising a contact spring received in the socket, the contact spring being electrically connected to the terminal body and being configured to be electrically connected to the pin, the contact spring being spring biased against at least one of the terminal body and the pin.

12. The power terminal connector of claim 1, further comprising a housing surrounding the terminal body, the cap being movable with respect to the housing, at least a portion of the spring clip moving with the cap with respect to the housing when the cap is moved.

13. The power terminal connector of claim 1, wherein the spring clip is oval shaped in the locking position and substantially ring shaped in the clearance position.

14. A connector system comprising:

a header having a power terminal, the power terminal having a pin with a groove; and a power terminal connector coupled to the power terminal of the header, the power terminal connector comprising:

a terminal body having a socket receiving, and being electrically connected to, the pin of the power terminal;

a spring clip coupled to the terminal body, the spring clip being movable between a locking position and a clearance position, the spring clip being received in the groove and engaging the pin of the power terminal in the locking position to secure and lock the power terminal connector to the power terminal, the spring clip being removed from the groove and disengaged from the pin of the power terminal in the clearance position; and a cap coupled to the terminal body, the cap being coupled to the spring clip to move the spring clip between the locking position and the clearance position as the cap is actuated.

15. The connector system of claim 14, wherein the header includes a box-shaped header shroud having an open top and an open side, the header shroud surrounding the pin, the power terminal connector being loaded into the header shroud through the open top, the power terminal connector extending from the header shroud through the open side.

16. The connector system of claim 14, wherein the pin extends along a pin axis, the pin includes a pin head, the groove being located below the pin head and having a smaller diameter than the pin head, the spring clip being forced to spread apart as the spring clip is pressed onto the pin head, the spring clip being received in the groove to secure the power terminal connector to the pin, the power terminal connector being removable from the pin by actuating the cap to move the spring clip to the clearance position and lifting the power terminal connector off the pin in a direction parallel to the pin axis.

17. The connector system of claim 14, wherein the spring clip includes a first end and a second end, the first end being securely coupled to the terminal body, the second end being securely coupled to the cap, the spring clip changing shape when the cap is actuated in a rotatable direction.

18. The connector system of claim 14, wherein the spring clip has a first arm and a second arm joined at a closed side of the spring clip, the first arm extends to a first end, the second arm extends to a second end, the first end being securely coupled to the terminal body, the second end being securely coupled to the cap, the first arm being spread apart from the second arm as the cap is actuated in a rotatable direction and the spring clip is moved from the locking position to the clearance position.

19. The connector system of claim 14, further comprising a housing surrounding the terminal body, the cap being movable with respect to the housing, the spring clip having a first end and a second end and a ring between the first and second ends, the ring being configured to wrap at least partially around the pin in the locking position, the first and second ends being coupled to, and fixed in position with respect to, the housing, the ring moving laterally with the cap when the cap is actuated.

20. A connector system comprising:

a battery having a buss bar at a mounting pad;

a header coupled to the battery at the mounting pad, the header having a power terminal coupled to the buss bar, the power terminal having a pin; and power terminal connector coupled to the power terminal of the header, the power terminal connector comprising:

a terminal body having a socket receiving, and being electrically connected to, the pin of the power terminal;

a spring clip coupled to the terminal body, the spring clip being movable between a locking position and a clearance position, the spring clip engaging the pin of the power terminal in the locking position to secure and lock the power terminal connector to the power terminal, the spring clip being disengaged from the pin of the power terminal in the clearance position; and a cap coupled to the terminal body, the cap being coupled to the spring clip to move the spring clip between the locking position and the clearance position as the cap is actuated; wherein the spring clip is a metal spring clip that changes shape when the cap is actuated.

21. The connector system of claim 20, wherein the battery includes a top, a front, and a side all meeting at a corner, the battery includes a notched-out area at the corner, the mounting pad being provided at the notched-out area, the header being received in the notched-out area such that the header does not extend beyond the top, front or side, the power terminal connector being coupled to the power terminal of the header such that the cap does not extend beyond the top, front or side.

* * * * *